US010486841B2

(12) United States Patent
Düpper

(10) Patent No.: US 10,486,841 B2
(45) Date of Patent: Nov. 26, 2019

(54) PACK OF BONDED CONTAINERS, PRODUCTION METHOD, AND DEVICE FOR PRODUCING THE PACK

(71) Applicant: KHS GmbH, Dortmund (DE)

(72) Inventor: Josef Düpper, Bedburg-Hau (DE)

(73) Assignee: KHS GmbH, Dortmund (DE)

( * ) Notice: Subject to any disclaimer, the term of this patent is extended or adjusted under 35 U.S.C. 154(b) by 457 days.

(21) Appl. No.: 15/304,142

(22) PCT Filed: Apr. 13, 2015

(86) PCT No.: PCT/EP2015/057941
§ 371 (c)(1),
(2) Date: Oct. 14, 2016

(87) PCT Pub. No.: WO2015/165722
PCT Pub. Date: Nov. 5, 2015

(65) Prior Publication Data

US 2017/0036790 A1 Feb. 9, 2017

(30) Foreign Application Priority Data

Apr. 28, 2014 (DE) ..... 10 2014 105 901

(51) Int. Cl.

| | |
|---|---|
| ***B65B 17/02*** | (2006.01) |
| ***B65D 21/02*** | (2006.01) |
| ***B65B 61/18*** | (2006.01) |
| ***B65B 27/04*** | (2006.01) |
| ***B65B 21/06*** | (2006.01) |

(52) U.S. Cl.
CPC ..... *B65B 17/02* (2013.01); *B65B 27/04* (2013.01); *B65B 61/182* (2013.01); *B65D 21/0205* (2013.01); *B65B 21/06* (2013.01)

(58) Field of Classification Search
CPC ..... B65B 21/00; B65B 17/00; B65B 17/02; B65B 61/182; B65B 27/04; B65B 21/06; B65D 21/0205
USPC ... 53/446, 448, 543, 544, 412, 133.5, 133.6, 53/133.7, 133.8; 206/139–203; 229/239, 229/125.22, 125.38, 311
See application file for complete search history.

(56) References Cited

U.S. PATENT DOCUMENTS

| | | | | |
|---|---|---|---|---|
| 1,391,433 A * | 9/1921 | Wallin | ..... | B65D 71/02 206/303 |
| 1,978,035 A | 10/1934 | Thorn | | |
| 2,677,460 A * | 5/1954 | Johnson | ..... | B65D 71/50 206/162 |
| 3,247,958 A | 4/1966 | Dreher | | |

(Continued)

FOREIGN PATENT DOCUMENTS

| | | |
|---|---|---|
| DE | 26 45 495 | 4/1978 |
| DE | 102011106759 | 9/2012 |

(Continued)

*Primary Examiner* — Chun Hoi Cheung
(74) *Attorney, Agent, or Firm* — Occhiuti & Rohlicek LLP

(57) ABSTRACT

A method for producing a pack from containers includes arranging containers into a container group, applying adhesive to the containers, placing an opening thread in the adhesive, attaching an engagement element to the opening thread, and joining the containers, the adhesive, the opening thread, and the engagement element, thereby forming the pack.

20 Claims, 2 Drawing Sheets

(56) References Cited

U.S. PATENT DOCUMENTS 3,343,746 A * 9/1967 Shiffman ..... B65D 21/0227 206/503
3,388,791 A * 6/1968 Walsh ..... B65D 21/0205 206/162
3,756,395 A * 9/1973 Ganz ..... B65D 71/10 206/161
3,759,373 A * 9/1973 Werth ..... B65D 21/0205 206/139
3,759,378 A 9/1973 Werth
3,902,992 A * 9/1975 Schuster ..... B65D 21/0205 206/162
4,817,866 A * 4/1989 Wonnacott ..... B65D 5/441 206/141
5,626,250 A * 5/1997 Dorazio ..... B65D 75/5888 220/4.26
6,223,499 B1 * 5/2001 Wilkey ..... B65B 17/02 53/399
6,338,410 B1 * 1/2002 Wasmund ..... B65D 85/1072 206/497
6,513,657 B2 * 2/2003 Sheehan, Jr. ..... B65D 71/08 206/428
7,198,070 B1 * 4/2007 Hansen ..... B65B 17/02 141/20
7,673,788 B2 * 3/2010 Calabretta ..... B65D 75/66 225/97
7,832,553 B2 * 11/2010 Hartness ..... B29C 63/423 206/150
8,439,195 B2 * 5/2013 Perl ..... B65D 71/0085 206/150
9,550,591 B2 * 1/2017 Johren ..... B65B 17/02
9,598,213 B2 * 3/2017 Dapper ..... B65D 71/063
2010/0192515 A1 * 8/2010 Chalendar ..... B65B 21/02 53/396

FOREIGN PATENT DOCUMENTS

DE 10 2011 10726 1/2013
WO WO2013/004341 1/2013

* cited by examiner

PACK OF BONDED CONTAINERS, PRODUCTION METHOD, AND DEVICE FOR PRODUCING THE PACK

RELATED APPLICATIONS

Under 35 USC 371, this is the national stage of PCT/EP2015/057941, filed on Apr. 13, 2015, which claims the benefit of the Apr. 28, 2014 priority date of German application DE 10 2014 105 901.8, the contents of which are herein incorporated by reference.

FIELD OF INVENTION

The invention relates to packaging, and in particular, to packs of containers.

BACKGROUND

Packs made up of containers that are held together by an adhesive are advantageous because they are economical and because the adhesive is, as a rule, arranged between the containers. This means that the outer surface of the pack or the containers can be used for providing information.

It is known to produce such packs. However, it is sometimes difficult to release a container from such a pack. In some cases, particularly when the container's wall is sensitive or thin, releasing a container from the pack can deform or damage the container.

SUMMARY

An object of the invention is to provide a method and a device for producing a pack of containers that promotes removal of containers without damage to the containers.

In one aspect, the method includes arranging the containers as a group, attaching an adhesive element or adhesive, placing an opening thread in the adhesive element, either producing an engagement element at the opening thread or attaching it to the opening thread, and joining the containers, adhesive element, opening threads, and engagement element to form a pack.

The method promotes reliable and damage-free release of a container from a pack. It does so at the time the pack is produced by having an opening thread placed into the adhesive element at the engagement element. The user can therefore grip the opening thread at the engagement element by pulling the thread release or breaking open the adhesive element between containers to then remove a container from the pack. This reduces risk of container damage because only minimal forces are exerted on the container when it is released. In particular, the method avoids the deformation of the container that can arise from drawing the container from the adhesive element.

The method and device according to the invention are in particular configured for the continuous production of packs from containers. Such production may occur in a container-filling facility.

As used herein, containers refers to bottles, glasses, or cans made of plastic, glass, or metal.

As used herein, a pack comprises a group of at least two, and in most cases more than two containers that have been joined to one another.

As used herein, an adhesive element is what turns a group of containers into a pack. An adhesive element comprises a surface that bonds with the container material. A typical adhesive element is an adhesive substance made of synthetic material. Examples of adhesives include an acetate or acryl connection, as well as a material such as polyethylene. Particularly preferred are melt adhesives. The adhesive element can be formed from a thread or a strand of adhesive alone. But it can also be arranged in the form of one or more adhesive points between two containers. In some cases, the adhesive element contains fibers as reinforcement. The adhesive element can be referred to as "adhesive" or as "bonding element."

The opening thread, which facilitates the release of a container from a pack, is a thread made of plastic, paper, metal, cotton, wool, or the like. In some embodiments, the opening thread has a uniform cross-section. Examples include a thread, such as a plastic thread. In other embodiments, the opening thread is made of fibers or strands of fibers. Examples include threads made of cotton or silk. In other implementations, the thread is twisted paper. Also among the embodiments are those that use a metal thread having paper wound around it.

When packs are to be produced continuously, it is preferable that the opening thread be unwound as an endless thread from a spool. The thread can be fixed to the bonding element, which is then applied. Alternatively, the thread is placed into an adhesive element that has already been applied.

As a rule, at the time the thread contacts the adhesive element, the adhesive element will not yet have hardened. This means that the pack will not yet have been produced by the joining of the containers, the adhesive element, and the opening thread.

The joining of these structures comprises pressing containers together to guarantee contact with the adhesive element(s) over a prescribed period of time that depends on the adhesive used. Waiting sufficient time guarantees that the adhesive will have hardened by the time pressure is released. Depending on the adhesive, it may be appropriate to increase the ambient temperature above room temperature. Also depending on the adhesive, it may be appropriate to expose it to radiation for curing or hardening. The joining can then also comprise the alignment of the containers such that, for example, printing on the containers is oriented toward the outside so as to be easily visible.

When using the opening thread, i.e. when breaking open one or more adhesive elements, it is necessary to apply force. To reduce this force, the thread's diameter should be as thin as possible. The thickness of the thread is, in most cases, between 0.3 mm and 2 mm, and preferably between 0.7 mm and 1.5 mm. The thread should be capable of being subjected to a tensile force of 100 N, preferably of at least 200 N, and advantageously of at least 300 N.

In view of the figures given, it is clear that the handling of a thin opening thread is subject to the transfer of greater tensile force for the user such that the user can grip the opening thread securely in order to ensure that the opening thread breaks the adhesive element(s) open.

An engagement element is therefore formed or attached on the opening thread. Certain particularly simple embodiments form an engagement element on the opening thread by having the opening thread itself form the engagement element. This can be achieved, for example, by laying the opening thread in a loop. The opening thread can, for example, be laid doubled by winding around a bar, lever, or hook, at least over a section of the length of the pack, or over the entire length of the pack. The loop that is thereby produced at one end should project over the containers such that it can be gripped easily by the user. The production of a loop as an engagement element requires a reversal of the direction in which the opening thread runs. This can prove to be an elaborate procedure with the continuous production of packs. On the other hand, the single laying of an opening thread laid as a loop is very simple to implement.

The securing of an engagement element takes place using a separate engagement element that is not identical to the opening thread. This involves fixing the separate engagement element to the opening thread. This fixing can be as non-positive fixing, positive fixing, or fixing by a material-joining fit. Typical embodiments include the formation of an engagement element around the opening thread, the locking of the opening thread at the engagement element, adhesive bonding, and the formation of a frictional contact. Such frictional contact can be formed by winding the engagement element around. Some embodiments also include a combination of two or more of the foregoing techniques.

In some embodiments, the engagement element is made of plastic. In others, it is made of metal.

The engagement element can be of any desired form. It may comprise an engagement piece, which, for example, passes through a ring-shaped body. In this situation, the ring-shaped body can be round or polygonal, triangular, or rectangular. The ring-shaped body can, however, also be configured as cylindrical, square, conical, or as an inverted cone. Preferably, the engagement element is of ergonomic configuration. Such configurations typically have a section for being gripped by fingers. This gives the user a handhold with which to pull on the opening thread.

To secure the opening element, the engagement element comprises, according to an advantageous embodiment, a thread-securing structure. Examples of a thread-securing structure include projections, inserts, cut-outs, back-cuts, notches, hooks, or the like, at the engagement element. These thread-securing structures secure the opening thread, and therefore secure the engagement element on the opening thread.

The thread-securing structure can either secure the opening thread directly, e.g. by winding the opening thread around a hook. Winding, however, is time-consuming, and, although it can be done mechanically, it requires complex devices. As an alternative, the opening thread can be prepared for the locking technique, for example by producing a thickened portion of the material, such as a knot or a sling. The thickened portion of the material can then be anchored at a hook, a back-cut, an insert, a cut-out, or a notch. This anchoring secures the engagement element to the opening thread.

The thread can also be laid through guide elements, which are provided by a laying device, precisely positioned into a cut-out opening. Advantageously, all of the foregoing securing techniques can additionally be secured by adhesive bonding.

One embodiment of an engagement element makes provision for the engagement element to be divided, either fully into two halves, or into two halves divided by a hinge. The halves close around the opening thread after the thread has been positioned. This secures the insertion element to the opening thread. Preferably, arranged at the engagement element are one or more of the thread-securing structures described heretofore. Upon closing of the halves, these engage one another to reliably secure the engagement element to the opening thread.

Preferably, the methods described herein are applied with the continuous production of packs. The term "continuous" includes the cyclic production of packs. In such embodiments, a long opening thread is used in the production of the packs. The thread has its first end at a first end of the pack has its second end at the engagement element. A cutting device, which is arranged at the device for producing the pack, separates the opening thread during or after the production of the pack. The cutting device can be configured, for example, as a rotating blade or as a blade which cuts in both an upwards and downwards motion.

In one aspect, the invention features a device for the production of a pack of containers. Such a device includes a transport device for joining and, as applicable, aligning containers to form a container group, an adhesive bonding device for applying an adhesive element to the containers, an insertion device for inserting an opening thread into the adhesive element, a securing device for securing an engagement element to the opening thread, and a joining device for joining a pack of containers, which are arranged in a container group, to an adhesive element, an opening thread, and an engagement element.

Containers are moved by feed devices, such as, for example, transport stars, carriers of conveyor devices, and the like, and are arranged into groups, for example, by baffle plates or guide elements. The alignment of containers takes place in most cases by containers being rotated, after optical sensing of the initial position on a take-up device, in such a way that an individual container, or the containers from a group, are oriented in accordance with specific criteria, in an end position. The criteria frequently make provision, for example, for labels to face outwards such as to be clearly visible.

An adhesive bonding device is a device comprising a reservoir for the adhesive element, as a rule adhesive or an adhesive thread, and a delivery device. The delivery device applies the adhesive onto the container. The delivery device can apply adhesive in point form or in the form of a line onto the container, but can also apply a thread of adhesive between containers, also applying the adhesive onto the container in point form or in the form of a line. The adhesive applicator can be supplemented by a hardening or curing device for the adhesive, for example a drying or heating device, with which the adhesive can be dried and, as appropriate, hardened or cured. The hardening device can be arranged to be spatially separated from the reservoir and the delivery device.

The device further comprises an insertion device for the insertion of an opening thread into the adhesive element. The insertion device comprises a store of the opening thread, either a spool or threads already cut to length, as well as a laying device for the opening thread, by means of which the thread is laid into the adhesive element. Preferably, an endless thread is processed from a spool, which can be processed particularly easily.

The laying device can be formed by levers, which, as appropriate, are arranged to be movable, but can also comprise baffle plates or the like. The laying device lays the opening thread into the adhesive element. The opening thread can either remain in the adhesive element, i.e. surrounded by adhesive, or the opening thread can be guided through the adhesive element and lie in contact with the container. Both embodiments are suitable; either, when the opening thread is pulled, the adhesive element is torn open, or it is removed from one of the two containers which are connected by the respective adhesive element. The opening thread is preferably guided between the containers and the adhesive elements respectively in such a way that it touches each container of the pack at least once at a bonding element. Ideally, the opening thread is guided at least between 2×2 containers, and therefore bridges at least once the common gap between the four adjacent containers. The containers of the pack can optionally comprise further bonding elements, through which the opening thread is not guided. With this embodiment, too, which relates to a particularly reliable pack for transport, the individual containers can be released from the pack more easily and in a manner that more readily avoids container damage.

In an alternative embodiment, to avoid having someone mistakenly use the opening thread as a carrying handle, the opening thread is guided vertically (related to containers standing upright) between two bonding elements, arranged above one another, of only two adjacent and connected containers.

In another aspect, the device for producing packs from containers comprises a securing device for securing an engagement element to the opening thread. The securing device is configured, in a simple configuration, as a hook, lever, or bar, which produces a loop in the opening thread. Preferably, the securing device comprises a store for engagement elements and a fixing device, by means of which the engagement element is secured to the opening thread.

According to a further embodiment, the securing device comprises a guide for guiding the engagement element to the opening thread. The store is preferably configured in such a way that it takes up a number of engagement elements and issues them in an arranged and ordered manner. The ordered issue, i.e. the issue of the engagement elements in a specific and predetermined alignment, is preferred, since thereby the desired engagement between the engagement element and the opening thread is guaranteed. The guide guarantees a correct engagement of the engagement element and the opening thread.

If required, the guide comprises a section that detects the opening thread and controls its orientation relative to the engagement element, with projections, inserts, hooks, backcuts, and the like attached to it as appropriate.

The fixing device produces the securing arrangement selected in each case between the engagement element and the opening thread. The fixing device can preferably be configured such as to deform the engagement element. And it can be configured such as to join an engagement element consisting of two or more parts. The fixing device can be configured such as to lock the engagement element to the opening thread, in order to produce a positive fit. The fixing device can be configured such as to wind the engagement element, with the opening thread, somewhat in the manner of a coil, in order to produce a friction grip, i.e. a non-positive fit. The fixing device can comprise a welding device or an adhesive applicator that welds or adhesively bonds the opening thread to the engagement element, in order to produce a material-joining fit. The fixing device can comprise each individual one of the foregoing securing techniques in conjunction with a welder or adhesive applicator. For example, the fixing device can be configured for winding the engagement element such that initially a securing of the engagement element to the opening thread is guaranteed, but wherein, in order to increase the strength of the connection, additional adhesive is applied, or sections of the engagement element are welded to one another or to the opening thread.

Preferably, the engagement element connects to the opening thread over the entire length or the entire circumference respectively. But, according to a simple and economical embodiment, a section-by-section connection is also sufficient, inasmuch as it guarantees an adequate tensile force on the opening thread. The particular configuration of such a connection can be determined by a few experimental efforts.

An alternative embodiment replaces the securing device with a device for producing a loop of the opening thread. The opening thread in this situation is guided in double length through the container group, wherein the section laid for the loop projects over the end of the container group. Either the loop can be used directly for the acquisition and application of tensile force, i.e. for releasing individual containers from the pack.

According to a further preferred embodiment, in addition to the device for producing a loop of the opening thread, a securing device can also be provided for securing an engagement element to the loop. The engagement element can be a sleeve that is laid in the area of the loop around the opening thread.

The device further comprises a joining device for joining the containers, which are assembled to form a container group, the adhesive element(s), the opening thread, and the engagement element, into a pack.

The joining device can be formed from a guide, such as a press bar or baffle plate, that exerts pressure onto the containers such that an adequately strong and loadable connection is established between the containers and the adhesive element with the opening thread arranged therein. The pressure is exerted onto the containers for a long enough time to permit the adhesive to develop a specified adhesive strength, for example by having cooled off, dried, or hardened. The joining device can be arranged directly after the laying of the opening thread. But it can also be arranged after the securing device for the engagement element.

BRIEF DESCRIPTION OF THE DRAWINGS

These and other features of the invention will be apparent from the following detailed description and the accompanying figures, in which.

DETAILED DESCRIPTION

Figure 1:
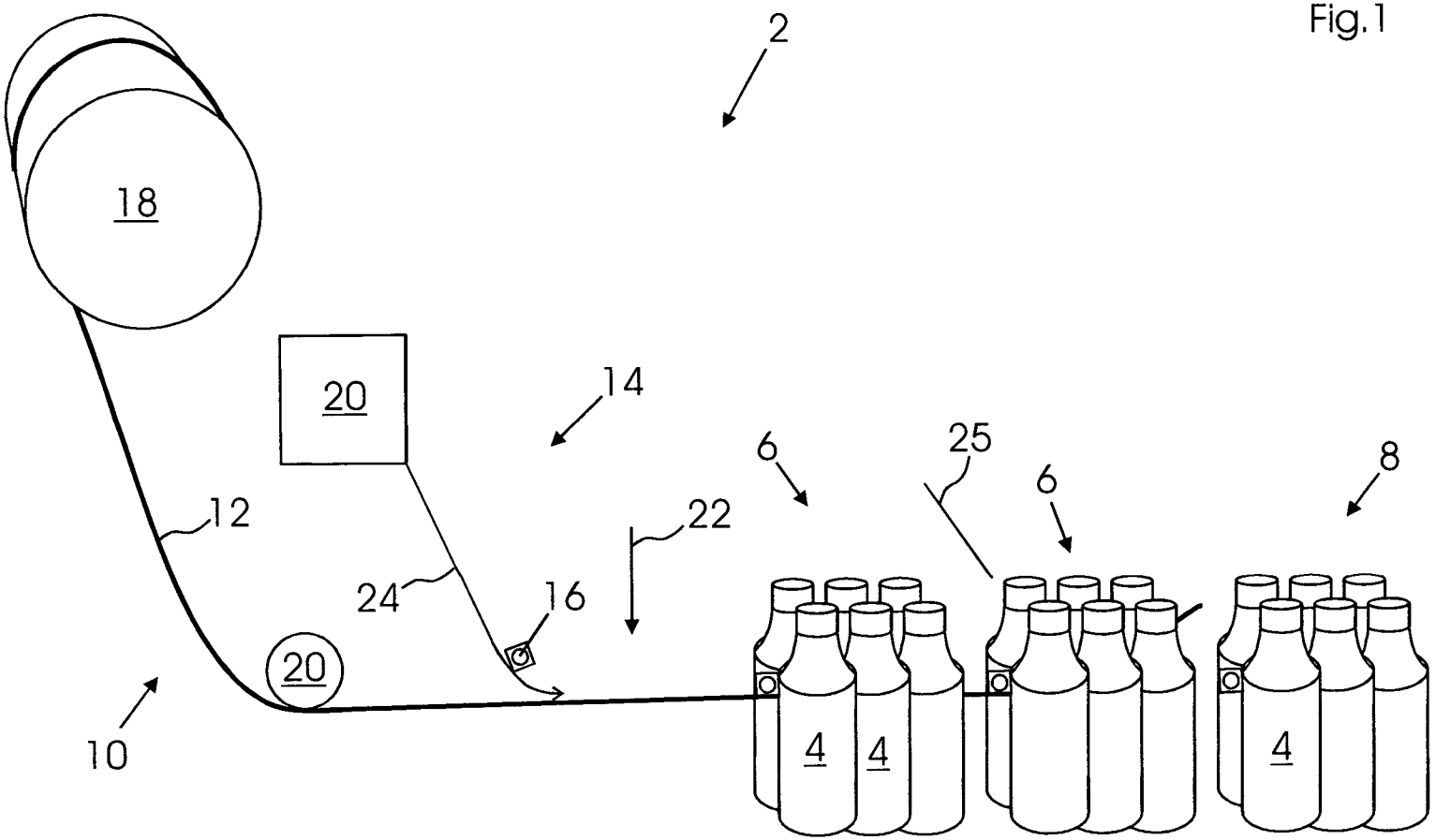
FIG. 1 shows a schematic representation of a device for producing packs from containers.

As show in FIG. 1, an apparatus 2 for producing packs 8 from containers 4 includes a transport device for joining and aligning containers 4 to form container groups 6. These groups 4 are then connected to form the packs 8. The apparatus 2 includes an adhesive applicator for applying an adhesive, an insertion device 10 for inserting an opening thread 12 into the adhesive, a securing device 14 for securing an engagement element 16 to the opening thread 12, and a joining device for joining the containers 4, which have been arranged in a container group 6, the adhesive and the opening thread 12, as well as the engagement element 16, to form a pack 8.

The transport device moves the containers 4 and arranges them to form a two-row container group 6. A feed device arranges the containers 4 into sequential container groups 6. A suitable feed device is a conveyor belt provided with carrier elements. After having had their initial positions optically sensed, an accommodation element aligns the containers 4. It does so by rotating them such that the labels face outwards. This permits the labels to be seen in the finished pack 8.

The adhesive applicator applies a line of adhesive onto the container 4. In some embodiments, the adhesive is a combination of melt adhesive on an acetate base.

The insertion device 10 directly follows the adhesive applicator. As a result, upon insertion of the opening thread 12, the adhesive has not had a chance to harden, to dry, or to cure.

The insertion device 10 includes a spool 18 and a laying device 20 that cooperate to lay the endless opening thread 12 into the adhesive. The opening thread 12 is an endless thread, which in one embodiment is a 0.7 mm thick wire.

In the illustrated embodiment, the container group 6 is made up of containers 4 arranged in two rows. Elements of adhesive are applied to those parts of the containers 4 that face each other. In a preferred embodiment, an adhesive element connects each container 4 to each adjacent container 4 of the container group 6, thereby forming a pack 8.

The illustrated embodiment implements the laying device 20 as a roll located at the same height as the adhesive. This roll lays the opening thread 12 between the two rows of containers 4 along the middle of the adhesive, thus surrounding the opening thread 12 with adhesive. In a first embodiment, the opening thread 12 is guided between the containers 4 in such a way that it touches each container 4 of the pack 8 at least once at an adhesive. A second embodiment introduces and lays the opening thread 12 laterally so that it contacts the containers 4.

Both embodiments promote easy removal of containers 4. In one embodiment, pulling the opening thread 12 rips off the adhesive. In the other, pulling one of the two containers 4 connected to by the adhesive removes the opening thread 12.

The apparatus 2 for producing packs 8 from containers 4 also includes a securing device 14 for securing the engagement element 16 to the opening thread 12. The securing device 14 includes a store 20 and a fixing device 22, the latter being represented schematically by an arrow. The store 20 delivers individual engagement elements 16 in a specified orientation. The fixing device 22 then secures the engagement element 16 to the opening thread 12.

The apparatus 2 also includes a joining device for joining the containers 4, the adhesive element(s), the opening thread 12, and the engagement element 16 to form a group 6. In the illustrated embodiment, the joining device includes a press bar that exerts enough pressure onto the containers 4 to produce an adequately strong and loadable connection between the containers 4 and the adhesive, with the opening thread 12 arranged between them. The press bar exerts pressure onto the containers 6 long enough to permit the melt-adhesive to cool and develop a specified adhesion strength. In some embodiments, the joining device directly follows the insertion device 10 of the opening thread 12. But in other embodiments, the joining device follows the securing device 14 for the engagement element 16.

The endless opening thread 12 must be separated between the container groups 6 or, at the latest, after the pack 8 has been produced. A blade 25 for cutting the opening thread 12 can be arranged before or after the containers join together to form the pack 6. However, it is preferable to cut the opening thread 12 after the containers have been joined to avoid incorrect laying or drawing out of the opening thread 12.

Accordingly, a pack 8 of containers leaves the apparatus 2. This pack 8 has at least two containers 4 connected to each other by at least one adhesive element, and in some cases, by two adhesive elements. An opening thread 12 runs between the containers 4 of the pack, and extends over the entire length of the pack 8. At one end of this opening thread 12 is an engagement element 16.

Figure 2:
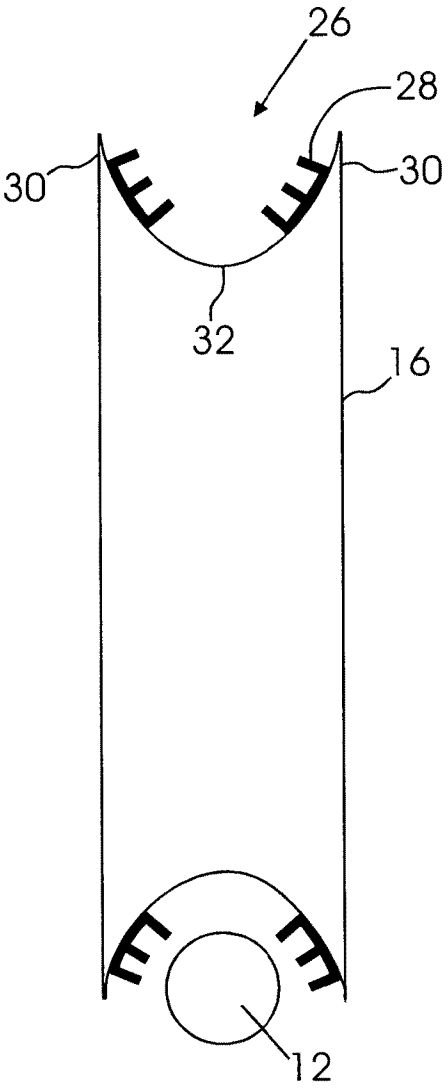
FIG. 2 shows an engagement element.

FIG. 2 shows a side view of one of these engagement element 16. The engagement element 16 is a ring of plastic or metal, such as aluminum having a concentric cut-out opening 26 that is just the right size to accommodate the opening thread 12. Projections 28 extend from the wall of the cut-out opening 26. These projections 28 fix the opening thread 12 into the cut-out opening 26. In an alternative embodiment, the cut-out opening 26 is shaft-shaped or prism-shaped. Such an embodiment can avoid the use of the projections 28.

Referring back to FIG. 1, the securing device 14 further comprises a guide 24 for guiding the engagement element 16 toward the opening thread 12, and ultimately, to set the engagement element 16 onto the opening thread 12. A lever lays the opening thread 12 around the engagement element 16. A fixing device 22 then deforms the engagement element 16 about the opening thread 12, such that the engagement element 16 This secures it to the opening thread 12.

In one embodiment, once the engagement element has been set onto the opening thread, a lever arrangement winds the opening thread 12 around the engagement element 16. In an alternative embodiment, the engagement element 16 is simply pressed onto the opening thread 12. This deflects the opening thread 12 out of its original position and causes it to partially surround the engagement element 16.

In one embodiment, the fixing device 22 includes two grip jaws that, when squeezed together, deform outer sections 30 of the cut-out opening 26 so that they contact one another. This causes the engagement element 16 to enclose the opening thread 12. Under these circumstances, the projections 28 support the fixing of the opening thread 12 by holding the opening thread 12 while the fixing device 22 deforms the cut-out opening 26. The projections 28 then secure the opening thread 12 in its position after the deformation, thus preventing it from slipping.

In an alternative embodiment, a shaft-shaped or prism-shaped cut-out opening 26 both accommodates the opening thread 12 and also carries out the function of fixing the opening thread 12. In this embodiment, each outer section 30 of the cut-out opening 26 has a greater wall thickness than the base 32.

Once a consumer purchases the pack 8, it is easy for the consumer to spot the ring formed by having deformed the engagement element 16. The consumer can then apply the necessary traction force onto the opening thread 12.

Some embodiments promote more reliable securing of the opening thread 12 at the engagement element 16 by deforming the opening thread 12 at the section thereof in which it contacts the engagement element 16. An example of such deformation is that of transforming an originally circular cross-section into a flatter cross-section. This enlarges the contact surface at which the opening thread 12 contacts the engagement element 16. This technique is of particular effectiveness when the opening thread 12 is a plastic thread.

In an alternative embodiment, the engagement element 16 can also be shaped in the form of a sleeve having two halves. The two halves are either individual halves or halves that are integrally connected to one another in a manner similar to that shown in connection with the ring represented in FIG. 2. The sleeve can, for example, be secured around a loop, on which the opening thread 12 is laid.

The different embodiments described in connection with this invention can be combined with one another in individual or multiple aspects.

The invention claimed is:

1. A method comprising producing a pack from containers, wherein producing a pack comprises arranging containers into container groups, applying adhesive to said containers, prior to said adhesive having hardened, placing an opening thread in said adhesive, attaching an engagement element to said opening thread, and joining said container groups, said adhesive, said opening thread, and said engagement element, thereby forming said pack, wherein said adhesive is melt adhesive, and wherein said container groups each comprise at least two rows.

2. The method of claim 1, further comprising using said opening thread for forming said engagement element.

3. The method of claim 1, further forming said engagement element by laying said opening thread in a loop.

4. The method of claim 1, wherein attaching said engagement element comprises causing a positive fit between said engagement element and said opening thread.

5. The method of claim 1, wherein attaching said engagement element comprises causing a non-positive fit between said engagement element and said opening thread.

6. The method of claim 1, further comprising deforming said engagement element to establish a connection between said engagement element and said opening thread.

7. The method of claim 1, further comprising adhesively bonding said engagement element and said opening thread.

8. The method of claim 1, further comprising using friction to grip said engagement element and said opening thread.

9. The method of claim 1, further comprising locking said engagement element and said opening thread.

10. The method of claim 9, wherein locking comprises causing a thickened portion of said thread to engage said engagement element.

11. The method of claim 1, wherein said engagement element that is attached to said opening thread comprises a gripping section by which a user is able to grip said thread at said engagement element and a thread-securing section.

12. The method of claim 1, wherein arranging containers in a container group comprising rotating said containers such that labels of all containers face outwards when said containers have been arranged in said container group.

13. The method of claim 1, further comprising deforming said engagement element.

14. The method of claim 1, further comprising closing two halves of said engagement element around said opening thread after said opening thread has been positioned.

15. The method of claim 1, further comprising causing a securing device to secure said engagement element to said opening thread.

16. The method of claim 1, wherein applying said adhesive to said containers comprises applying a line of said adhesive.

17. The method of claim 1, wherein said melt adhesive is on an acetate base.

18. The method of claim 1, further comprising pressing said containers together until such time as said adhesive has hardened.

19. The method of claim 1, further comprising laying said thread between two rows of containers along a middle of said adhesive, thereby surrounding said thread with adhesive.

20. The method of claim 1, wherein said engagement element is separate and distinct from said adhesive and wherein attaching said engagement element occurs after having placed said opening thread in said adhesive.

* * * * *